US006149106A

United States Patent [19]

McQuistian

[11] Patent Number: 6,149,106

[45] Date of Patent: Nov. 21, 2000

[54] RAILROAD SWITCH POINT POSITION INDICATOR

[75] Inventor: Kevin M. McQuistian, County of Westmoreland, Pa.

[73] Assignee: Union Switch & Signal Inc., Pittsburgh, Pa.

[21] Appl. No.: 09/146,513

[22] Filed: Sep. 3, 1998

[51] Int. Cl.[7] ..... B61L 5/00

[52] U.S. Cl. ..... 246/220; 246/253; 246/476

[58] Field of Search ..... 246/120, 121, 246/162, 176, 220, 253, 476

[56] References Cited

U.S. PATENT DOCUMENTS

| | | | |
|---|---|---|---|
| 4,005,839 | 2/1977 | Frank . | |
| 5,116,006 | 5/1992 | Ocampo . | |
| 5,192,038 | 3/1993 | Ocampo | 246/220 |
| 5,253,830 | 10/1993 | Nayer et al. | 246/220 |
| 5,598,992 | 2/1997 | Chew . | |
| 5,622,340 | 4/1997 | Turner et al. . | |
| 5,806,809 | 9/1998 | Danner | 246/220 |
| 6,062,514 | 5/2000 | McQuistian . | |

*Primary Examiner*—Mark T. Le
*Attorney, Agent, or Firm*—David V. Radack; Kirk D. Houser; Eckert Seamans Cherin & Mellott, LLC

[57] ABSTRACT

A fixed rail mounted railroad switch point indicator is provided, wherein proximity detectors are mounted to the fixed stock rail to sense the position of the switch relative to those stock rails. Preferably, eddy current sensors are used as the proximity sensors to indicate the distance of the switch points relative to the fixed rails. A microprocessor converts a current reading from the proximity detectors into the distance measurement, such as by indicating an "on/off" state of the sensor. Additionally, the microprocessor provides information as to the operation of the sensors to provide the reliability of the signals received.

15 Claims, 3 Drawing Sheets

RAILROAD SWITCH POINT POSITION INDICATOR

BACKGROUND OF THE INVENTION

1. Field of the Invention

The present invention relates to railroad switch devices, and more particularly to a switch point position indicator.

2. Description of the Prior Art

Railway turnouts alternately divert trains from one track to another set of tracks. A common turnout used in the industry has a switch property which includes switch points, a switch machine and an operating rod to initiate diversion of the wheels, a frog to carry the train wheel flanges across opposing rails and lead rails between the frog and the switch. The switch points are typically moved by means of the operating rod which is attached to the switch point and is also connected to the switch machine. In operation, the operating rod is translated by the switch machine causing the switch points to move.

Devices for determining whether or not a railroad switch is in the proper position are well known and have been used in switch mechanisms on railroads for many years. A switch circuit controller is a device that is typically mounted to the railroad ties and is connected to the point detector rod. The switch circuit controller provides a signal indicating the position of the switch point. The signal produced by the switch controller is a vital indication which means that the signal need not be checked further and may be presumed to be accurate. A description of typical railway switch circuit controllers can be found in U.S. Pat. No. 5,598,992 to Chew, which patent is assigned to the present assignee and is hereby incorporated by reference herein. By way of brief description, the location of the railroad switch is generally given by determining the location of the connecting rods which connect the switch lever to the railroad switch itself. Thus, the location of the lever is an indirect indication of the actual position of the railroad switch itself.

The railroad industry is a very harsh environment for any product. The environmental conditions that field mounted devices must endure are extremely harsh and design of such components must be very robust to survive. A switching device must enable the mounting and adjustment of the switch point indicators directly to the stock rail while performing dependable sensing of the switch point under all conditions.

The use of proximity sensors mounted to the switch points has previously been proposed. However, this scheme has several disadvantages. Since the railroad switch is exposed to the elements, it is necessary in colder climates to employ switch heaters to melt any snow or ice which could otherwise accumulate on the rails and prevent proper operation of the switch. Thus, mounting the detectors on the switch rails not only exposes these delicate instruments to the heating elements, but also to the hot air directed at the switch. Although the heaters are generally employed, a power interpretation to the heaters would adversely affect the operation of the proximity detectors. Additionally, mounting the sensors to the switch points means that they are also subjected to wear and tear caused by the cycling between the normal and reverse the positions of the switch.

Because of the potential for inaccurate readings due to these adverse operating conditions, a complex controller is typically required to ensure proper sensor operation. For example, in a system having proximity sensors located on the switch rails, as discussed above, Programmable Logic Controllers (PLC) are used in a checked redundant configuration for the switch points. By way of explanation, two proximity detectors are used for switch point detection and each proximity detector is operatively coupled with a PLC.

It is therefore an object of the present invention to provide a fail-safe switch position indication mechanism which more accurately indicates the actual railroad switch position.

It is another object of the present invention to provide a switch point position indicating mechanism which can survive and be dependable in the harsh environment typically found in railroad systems.

SUMMARY OF THE INVENTION

The above objects are obtained by the present invention, according to which, briefly stated, a proximity sensor is provided and operatively associated with the fixed rail of a switch device to detect the distance from the stock rail to the switch rail. A pair of sensors are provided on each of the parallel stock rails to determine the distance from each stock rail of the switch point to their respective switch points. The sensors will determine when the switch rail is in a position to connect with the stock rail on one side while also giving an indication that the switch point has moved relative to the stock rail on the opposite side. A controller is used to sense the position of the switch point indicators relative to the stock rails and to each other. The proximity sensors are placed on the railroad bed in such a manner so as to protect the devices from harsh environmental conditions, while also providing an accurate signal with respect to the switch point position.

BRIEF DESCRIPTION OF THE DRAWINGS

Various other objects, features and advantages of the invention will become more apparent by reading the following detailed description in conjunction with the drawings, which are shown by way of example only, wherein.

DETAILED DESCRIPTION OF THE PREFERRED EMBODIMENTS

Figure 1:
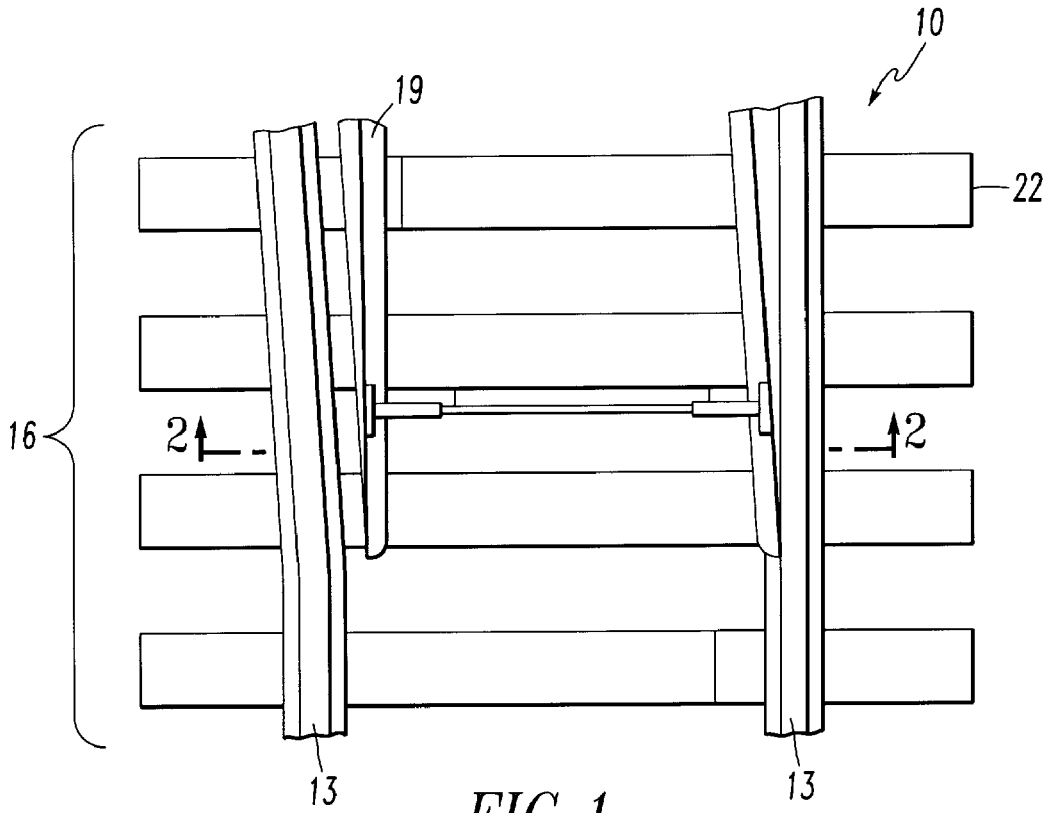
FIG. 1 PRIOR ART
FIG. 1 is a top elevational view of a typical railroad switch showing switch point tracks and stock rails.
Figure 2:
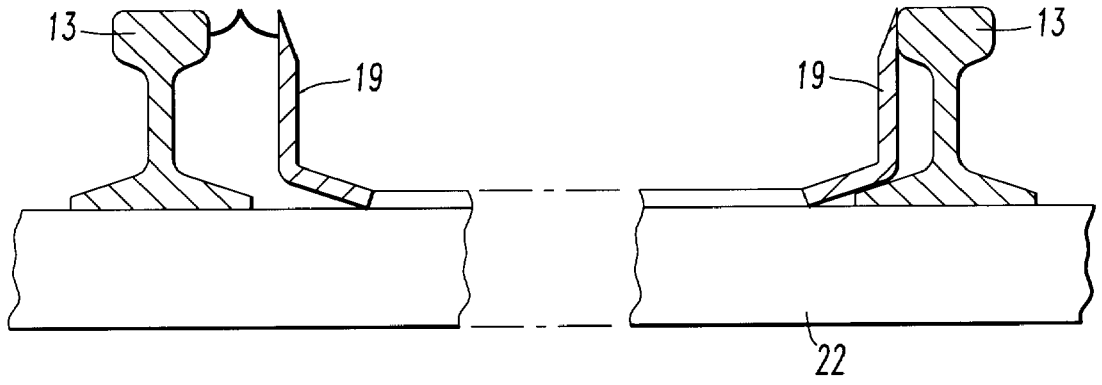
FIG. 2 PRIOR ART
FIG. 2 is a side elevational view of the switch taken along the lines 2—2 of FIG. 1.

Referring now to the drawings in detail, wherein FIGS. 1 and 2 show a typical railroad switch point 10 in which stock rails or tracks 13 are shown parallelly mounted to a railway web 16, as is well known in the art. A pair of spaced apart switch rails 19 are used and are alternately disposed between what are referred to as a normal and a reverse position. For purposes of this description, it will be assumed that the position shown in FIG. 1 is the "normal" position. The fixed tracks 13 are secured to ties 22 which together form the railway web or railroad bed. The railway switch alternates positions by a throw rod (not shown) which is connected to the railway switch at one end and at its opposite end to a switch lever (not shown).

Figure 3:
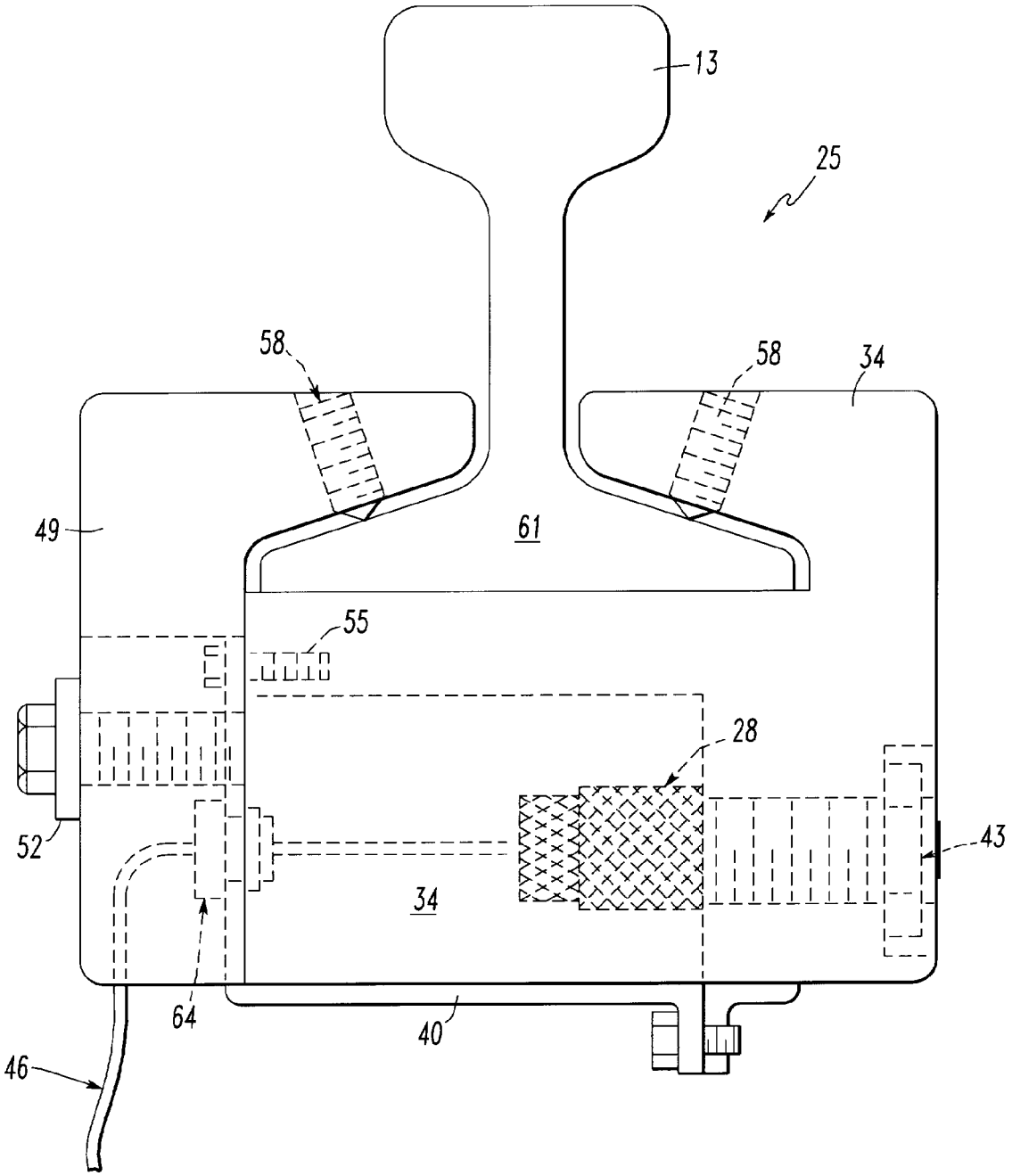
FIG. 3 is a side elevational view of the sensor housing mounted to the fixed stock rail.
Figure 4:
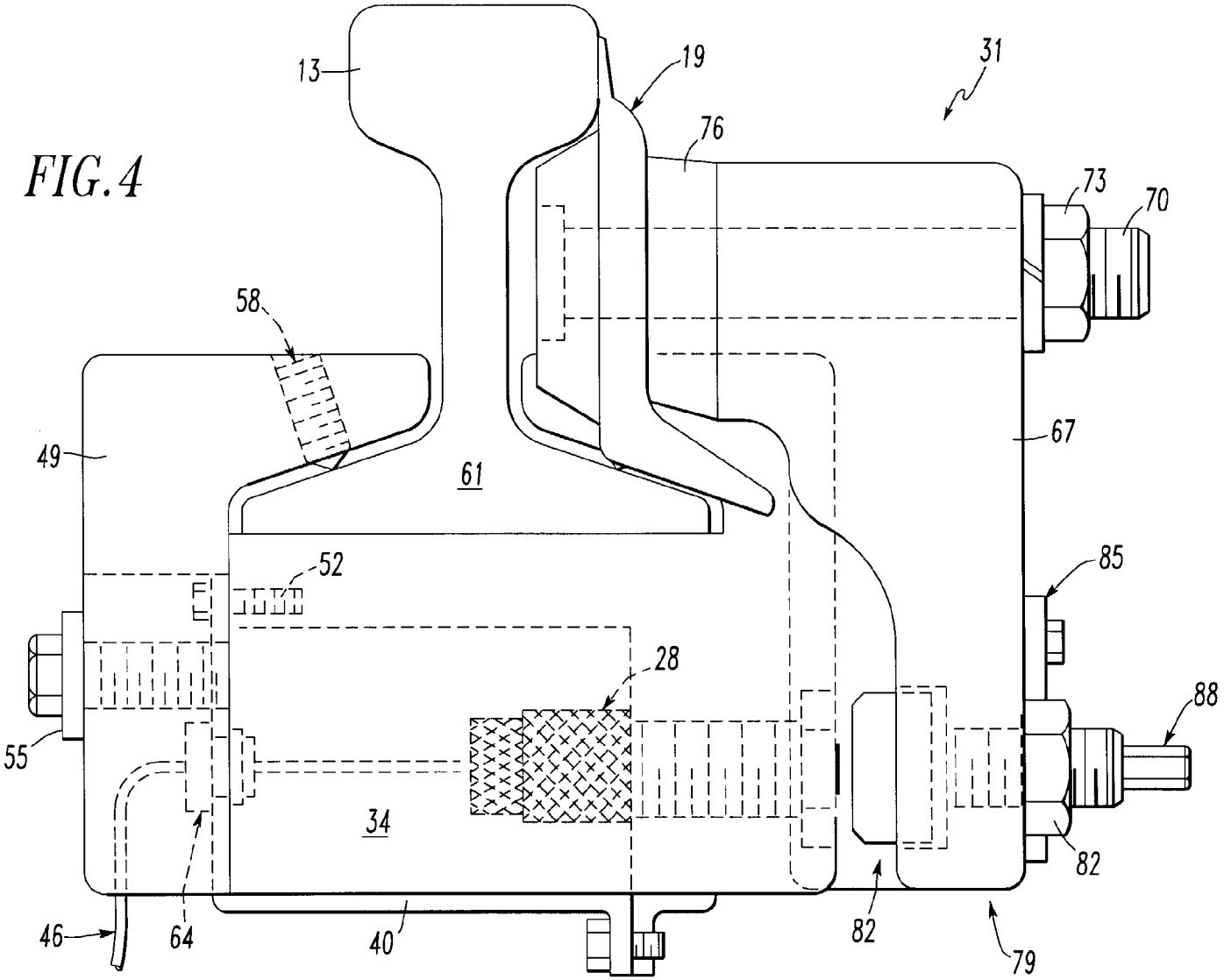
FIG. 4 is a side elevational view of a switch point mounted position indicating member according to the present invention.

Referring now in detail to FIGS. 3 and 4, there is shown a switch point indicating mechanism 25 which comprises a proximity sensor 28 mounted to one of the fixed rails 13 in the railway web and a switch position indicator 31 mounted on the movable switch point 19. A proximity sensor is similarly mounted to each of the stock rails. The proximity sensor 28 is mounted in a housing 34 attached directly to the stock rail 13 and is enclosed within a cavity 37 which protects the sensor 28 from natural elements, as well as heat that is generated by forced air snow melters (not shown) which are typically located in close proximity to the railroad switch point 10. Mounting the sensor within such a housing also prevents it from being damaged by foreign materials which are typically found at wayside railroad switches. Within the rail web, the sensor cavity is enclosed by a cover 40. The proximity sensor 28 is mounted within the housing 34 and secured thereto by a lock nut 43. A wire lead 46 from the sensor passes out of the sensor cavity 34 through a clamp 49 to the switch point power source (not shown). The housing 34 is secured to the clamp 49 by a bolt 52 and screw 55. A gland nut 64 allows for passage of the wire lead 46 through the clamp 49. This assembly is secured to the stock rail 13 preferably by a pair of pointed stainless steel screws 58 which secure the housing to the flange 61 on the fixed rail 13.

As shown in FIG. 4, a corresponding location mounted on each switch rail 19 is a point mounted bracket assembly 67. The bracket assembly is secured such as by bolt 70 and nut 73 to the switch rail 19 at the upper portion 76 which contacts the stock rail 13. On a lower portion 79 of the point mounted bracket assembly 67 is a stop stud 82 which is mounted in a position to be easily sensed by the proximity sensor 28. The stop stud 82 is secured to the lower portion 79 of the bracket assembly by means of a hex nut 82. If need be, adjustment of the stop stud 82 with respect to the proximity sensor 28 can be easily accomplished by removal of a bolt lock retaining plate 85 and turning the stop stud within the point mounted bracket assembly 67 so as to be accurately detected by the proximity sensor 28 (i.e., rotated to the left or right in the figure). The stop stud 82 is bolted in a threaded engagement to the point mounted bracket 67, and can be adjusted by grasping and rotating a hex 88 which is formed as part of the end of the threaded portion of the stop stud opposite the proximity sensor.

As will be readily recognized by those skilled in the art, a similar proximity sensor and stop stud arrangement is provided on the other switch rail so as to provide complementary indication of the switch rail being operatively engaged with the stock rail on one side while also being disengaged from the stock rail on the opposite side.

The proximity sensors 28 used with the present invention provides a lower margin of error than current conventional sensing methods. The ability to sense the switch point 19 relative to the stock rail 13 without interconnecting rods, levers and pipes common in prior art systems will enhance the safety of the rail industry by accurately indicating the position of switch points with respect to the stock rail. It is believed by the inventors that no device is currently available to securely satisfy the maintainability, reliability and stability of mounting proximity devices at the point of the rail. By mounting the sensor device in the rail web mounted housing 34, it is protected by the cover plate 40 that prevents saturation of the sensor due to water, snow or ice. Moreover, with the sensor mounted to the stock rail, the connecting lead 46 will not have to undergo constant motion under switch movement as well as being protected from the heat of the forced air snow melters. In a preferred embodiment of the invention the proximity sensors are eddy current devices which undergo a change in electrical current in response to the proximity of a metal object in relation to the sensor. The proximity sensor causes the current to increase when metal contacts or is in close proximity to the detector. In the present invention, the electrical current produced by the proximity sensor 28 is affected by the location of the stop stud 82. Thus, the amount of current within the sensor is an indication of the location of the movable switch rail 19 with respect to the fixed stock rail 13. In the figures, FIG. 3 corresponds to the "normal" switch position shown in FIG. 2 and FIG. 4 corresponds to the "reverse" switch position.

By mounting the sensor to the stock rail, the distance from the stock rail to the switch point can be determined by measuring the current within the sensor. The sensors 28 indicate the proximity of the movable switch rail 19 with respect to the stock rail 13 by the sensor reacting to the relative position of the stop stud 82, indicating the position of the switch. The proximity sensors are connected to indicator means, such as a microprocessor controlled display (not shown) which converts the current sensed from the sensors into the required distance measurement. Thus, the indicator means indicates to the operator the relative position of each of the switch rails with respect to the stock rail, such as by an "on/off" indication from the sensor. In the locked normal position, for example, one sensor (the one mounted to the right rail) would have the highest current (i.e., "on"), while the opposite sensor (the one connected to the left rail) would have the lower current indicating that the switch rail is at the farthest point from the stock rail (i.e., "off"). Both outputs are an indication that the switch point 10 is in the normal position. Conversely, in the reverse position, the second sensor connected to the left rail would have the highest current whereas the first sensor connected to the right rail would have the lowest current output.

The microprocessor may also test whether or not the sensors are operating correctly, and thus provide assurance that the proximity detectors are operating correctly and are indicating the actual position of the switch point relative to the stock rails. The current outputs from the respective sensors will change as the switch is cycled between the normal and reverse positions, and the output is calibrated to reflect the distance of each of the respective switch rails 19 from each of the fixed rails 13. Thus, complex programmable logic controllers are not needed to provide an indication of both the switch points and the lock bar, for example, without having to indicate which themselves did not give an indication that the sensors are operating correctly.

Once the microprocessor performs continual back checking in the condition of the sensors, the controller will automatically know that the proximity detectors are operating in the correct manner. If not, the microprocessor can automatically shut down the system and provide an indication that the switch point indicator is not operating correctly, indicating the need for corrective action. The microprocessor continually polls the operating parameters of the proximity detectors to ensure that the operation is within those acceptable parameters. Thus, the present invention provides an automatic indication of the correct operation of the switch point indicator.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

What is claimed is:

1. A railroad switch point indicator for a railroad switch point including a pair of fixed stock rails and a pair of movable switch rails disposed between said stock rails and alternately movable between a normal position and a reverse position wherein a first one of said switch rails contacts a first one of said stock rails in the normal position and a second one of said switch rails contacts a second one of said stock rails in the reverse position, the railroad switch point indicator comprising:

a first protective housing structured for direct connection to the first fixed rail;

a second protective housing structured for direct connection to the second fixed rail;

a first proximity detector enclosed in said first protective housing for providing a first output indicative of the position of the first switch rail with respect to the first stock rail;

a second proximity detector enclosed in said second protective housing for providing a second output indicative of the position of the second switch rail with respect to the second stock rail; and indicator means operatively connected to said first and second proximity detectors and receiving as inputs said first and second outputs, whereby said indicator means provides an indication of the position of the railroad switch point.

2. The railroad switch point indicator of claim 1, wherein said first and second proximity detectors are comprised of eddy current sensors.

3. The railroad switch point indicator of claim 1, further comprising a first target connected to said first switch rail and a second target connected to said second switch rail, wherein said first proximity detector is operatively associated with said first target and said second proximity detector is operatively associated with said second target.

4. The railroad switch point indicator of claim 1, wherein each of said first and second protective housings is structured for direct connection within a cavity of the respective first and second fixed rails.

5. The railroad switch point indicator of claim 2, further comprising a first target connected to said first switch rail and a second target connected to said second switch rail, wherein said first proximity detector is operatively associated with said first target and said second proximity detector is operatively associated with said second target.

6. The railroad switch point indicator of claim 5, wherein the first output comprises a first electrical current having a first maximum current value and a first minimum current value, and the second output comprises a second electrical current having a second maximum current value and a second minimum current value.

7. The railroad switch point indicator of claim 6, wherein said indicator means is a controller which provides a normal switch point indication when the first eddy current sensor provides the first maximum current value and the second eddy current sensor provides the second minimum current value.

8. The railroad switch point indicator of claim 6, wherein said indicator means is a controller which provides a reverse switch point indication when the first eddy current sensor provides the first minimum current value and the second eddy current sensor provides the second maximum current value.

9. The railroad switch point indicator of claim 2, wherein the first output comprises a first electrical current having a first maximum current value and a first minimum current value, and the second output comprises a second electrical current having a second maximum current value and a second minimum current value.

10. The railroad switch point indicator of claim 9, wherein said indicator means is a controller which provides a normal switch point indication when the first eddy current sensor provides the first maximum current value and the second eddy current sensor provides the second minimum current value.

11. The railroad switch point indicator of claim 10, wherein said controller provides a reverse switch point indication when the first eddy current sensor provides the first minimum current value and the second eddy current sensor provides the second maximum current value.

12. A railroad switch point comprising:

a pair of fixed stock rails and a pair of movable switch rails disposed between said stock rails and alternately movable between a normal position and a reverse position wherein a first one of said switch rails contacts a first one of said stock rails in the normal position and a second one of said switch rails contacts a second one of said stock rails in the reverse position;

a first eddy current sensor connected to the first fixed rail for providing a first output indicative of a variable distance between the first switch rail and the first stock rail, and a second eddy current sensor connected to the second fixed rail for providing a second output indicative of a variable distance between the second switch rail and the second stock rail;

a first target connected to the first switch rail and operatively associated with said first eddy current sensor, and a second target connected to the second switch rail and operatively associated with said second eddy current sensor; and indicator means operatively connected to said first and second eddy current sensors and receiving as inputs said first and second outputs, whereby said indicator provides an indication of the position of the railroad switch point.

13. The railroad switch point indicator of claim 12, wherein the first output comprises a first electrical current having a first maximum current value and a first minimum current value, and the second output comprises a second electrical current having a second maximum current value and a second minimum current value.

14. The railroad switch point indicator of claim 13, wherein said indicator means is a controller which provides a normal switch point indication when the first eddy current sensor provides the first maximum current value and the second eddy current sensor provides the second minimum current value.

15. The railroad switch point indicator of claim 14, wherein said controller provides a reverse switch point indication when the first eddy current sensor provides the first minimum current value and the second eddy current sensor provides the second maximum current value.

* * * * *